United States Patent [19]

Funabashi et al.

[11] Patent Number: 4,987,888

[45] Date of Patent: Jan. 29, 1991

[54] METHOD OF CONTROLLING FUEL SUPPLY TO ENGINE BY PREDICTION CALCULATION

[75] Inventors: Motohisa Funabashi, Sagamihara; Teruji Sekozawa, Kawasaki; Makoto Shioya, Tokyo; Mikihiko Onari, Kokubunji; Shinsuke Takahashi, Yokohama; Gohki Okazaki, Chigasaki, all of Japan

[73] Assignee: Hitachi, Ltd., Tokyo, Japan

[21] Appl. No.: 177,970

[22] Filed: Apr. 5, 1988

[30] Foreign Application Priority Data

Apr. 8, 1987 [JP] Japan ..... 62-84737

[51] Int. Cl.[5] ..... F02D 41/10; F02D 41/12; F02D 43/00

[52] U.S. Cl. ..... 123/488; 123/422; 123/423; 123/492; 123/493; 364/431.07

[58] Field of Search ..... 123/492, 493, 480, 489, 123/488, 494, 422, 423; 364/431.05, 431.07

[56] References Cited

U.S. PATENT DOCUMENTS

| | | | |
|---|---|---|---|
| 4,424,568 | 1/1984 | Nishimura et al. | 364/431.07 |
| 4,562,814 | 1/1986 | Abo et al. | 123/492 |
| 4,667,640 | 5/1987 | Sekozawa et al. | 123/492 |
| 4,712,529 | 12/1987 | Terasaka et al. | 123/492 |
| 4,732,125 | 3/1988 | Takizawa | 123/422 |
| 4,792,905 | 12/1988 | Sekozawa et al. | 123/480 |

FOREIGN PATENT DOCUMENTS

| | | | |
|---|---|---|---|
| 0087809 | 9/1983 | European Pat. Off. . | |
| 0134547 | 3/1985 | European Pat. Off. . | |
| 0185552 | 6/1986 | European Pat. Off. . | |
| 2124798 | 9/1972 | France . | |
| 59-196930 | 11/1984 | Japan | 123/492 |
| 2145470 | 3/1985 | United Kingdom | 123/492 |

*Primary Examiner*—Andrew M. Dolinar

*Attorney, Agent, or Firm*—Fay, Sharpe, Beall, Fagan, Minnish & McKee

[57] ABSTRACT

In a fuel supply control method of an automobile engine wherein a plurality of parameters representing an operating condition of the engine are measured, and a fuel supply quantity is determined based on the measured values so as to attain a target air-fuel ratio, an amount of air flowing into each cylinder in an n-th stroke (n is an arbitrary integer) is calculated for prediction by using the measured parameters in a stroke preceding the n-th stroke, and the fuel supply quantity is determined by the predicted value of the amount of air in the n-th stroke and a target value of the air-fuel ratio in the n-th stroke.

9 Claims, 4 Drawing Sheets

METHOD OF CONTROLLING FUEL SUPPLY TO ENGINE BY PREDICTION CALCULATION

BACKGROUND OF THE INVENTION

1. Field of the Invention

The present invention relates to a fuel supply control of an engine for automobiles, and in particular, to a method of controlling fuel supply suitable for performing the control to maintain an air-fuel ratio at a proper value.

2. Description of the Related Art

In a prior art fuel supply control system of the feedback control type, a fundamental fuel supply quantity Ti(n) (usually, given by a valve opening time period of a fuel injection valve) in an an n-th stroke is determined based on an air flow rate $Q_{ay}(n-1)$ at the inlet of a manifold measured in an (n−1)th stroke (n is an integer, and one stroke corresponds to ½ revolutions in a 4-cycle engine) and an engine speed N(n−1) as expressed by the following formula $$Ti(n) = k\frac{Q_{ay}(n-1)}{N(n-1)} \quad (1)$$

where, k: a correction coefficient.

The determined quantity of fuel is supplied to each cylinder. This fundamental fuel supply quantity Ti(n) is a value when the engine is in a steady state. At the transient time when the throttle valve is opened or closed as during acceleration or deceleration, a correction is made by adding a correction quantity to the fundamental fuel supply quantity. This correction quantity is obtained as a function of the amount of variation $\Delta\theta_{th}(n-1)$ with time in the degree of opening of the throttle valve as expressed by the following formula $$k = 1 + \mathrm{func}(\Delta\theta_{th}(n-1)) \quad (2),$$

and the fuel quantity to be supplied is determined by correcting the Ti(n) in formula (1) by the correction quantity k.

The calculation method according the formula (1) is to be determined by the fuel quantity to be supplied in the next n-th stroke by using the measured values including the air flow rate and engine speed in the (n−1)th stroke. In this method, if the intake air flow rate or engine speed is changed to a great extent between the (n−1)th stroke and the n-th stroke, the fuel quantity supplied in the n-th stroke will be deviated from a required fuel quantity in the n-th stroke. Thus, the A/F ratio (air to fuel ratio) will also be deviated from a target value. The appropriate fuel quantity to be supplied should be a value which matches the amount of air actually flowing into each cylinder in the n-th stroke. However, this amount of air flowing into the cylinder cannot be measured by the technique at the present time. Even it the amount of air flow into the cylinder can be measured, since a delay is involved in the calculation, it results in that the present fuel quantity is calculated based on the amount of air in the past stroke. For this reason, at the transient time, since a significant error is caused in the air-fuel ratio control, it is necessary to design the exhaust gas control device (catalyst, EGR, etc.) with a sufficient margin in the characteristic thereof more than required. Thus, there has been a problem in the cost and the drivability.

The formula (2) is intended to compensate for a follow-up delay in the fuel supply quantity during a transient state by using a change in the degree of opening of the throttle valve. Practically, however, much time and labor have been spent to experimentally obtain a function of the correction coefficient which satisfied both the reduction and exhaust gas components an the drivability. Although, not less than 50% of the development period of the control logic has been devoted, there is a problem in that the accuracy of control of the air-fuel ratio is still low.

SUMMARY OF THE INVENTION

An object of the present invention is to provide a logical formation for controlling the air-fuel ratio, which is capable of controlling the air-fuel ratio with high accuracy even in a transient state by predicting the amount of air flowing into the cylinder in a future stroke by a method that is adaptable for use with control systems of engines of varied types.

The above object can be achieved by introducing a calculation for accurately and rationally predicting the amount of air flowing into the cylinder in an n-th stroke based on measured data in an (n−1)th stroke and its preceeding strokes. For the calculation, it is considered to employ (1) a numerical formula model for prediction, and (2) a method for predicting the amount of air flowing into the cylinder in the n th stroke by introducing into a link mechanism consisting of an accelerator pedal and a throttle valve, an element involving a time delay so small as to be not sensed by the driver and by utilizing this time delay. In the calculation including both items (1) and (2), there is an advantage of making the prediction easier by introducing a physical delay element. On the other hand, when only the numerical formula model mentioned in item (1) is used, there is an advantage in that the control can be used without modifying at all the hardware structure of the engine control system existing at the present time.

In either case, it is a basic matter to predict the amount of air flowing into the cylinder according to a numerical formula. However, various methods for predicting the amount of air flowing into the cylinder are considered depending on how the fundamental model for prediction is formed, and further, how the inconsistency between the actual phenomenon and the fundamental model is corrected.

A prediction logic of the present invention includes a state estimation section and a prediction section. In the state estimation section, a physical quantity in an (n−1)th stroke required in the prediction section, or parameters which can not be measured are estimated by an object characteristic model and a measured value. In other words, the estimate value is obtained by calculating a measured value of an indirect point parameter.

The concrete realization of this prediction logic is attained by extensively applying a known Kalman filter or an observer theory. In the prediction section, by using the measured value, and the estimate value obtained in the state estimation section as initial values, the amount of air flowing into the cylinder in an n-th stroke is predicted based on a model representing a characteristic of the amount of air flowing into the cylinder. The quantity of fuel supply in the n-th stroke can be determined by this predicted value of the amount of air flowing into the cylinder and a target air-fuel ratio. By adopting such a logical formation, the measured value in the preceding stroke of the stroke in which the fuel is to be supplied is not used as it is for determining the quantity of fuel supply as in the prior art, but the measured value and the model of the characteristic of the measurement object are utilized collectively. Thus, a physical quantity (e.g., the amount of air flowing into the cylinder) which can not be measured in an on-board control system (e.g., a control system mounted on the actual engine) is estimated and predicted thereby to utilized in determining the fuel quantity. As a result, it is possible to clearly define logical formation for the control and to adapt the control logic to engines of various types, and at the same time, the control of the air-fuel ratio can be achieved with high accuracy.

DESCRIPTION OF THE PREFERRED EMBODIMENTS

Figure 1:
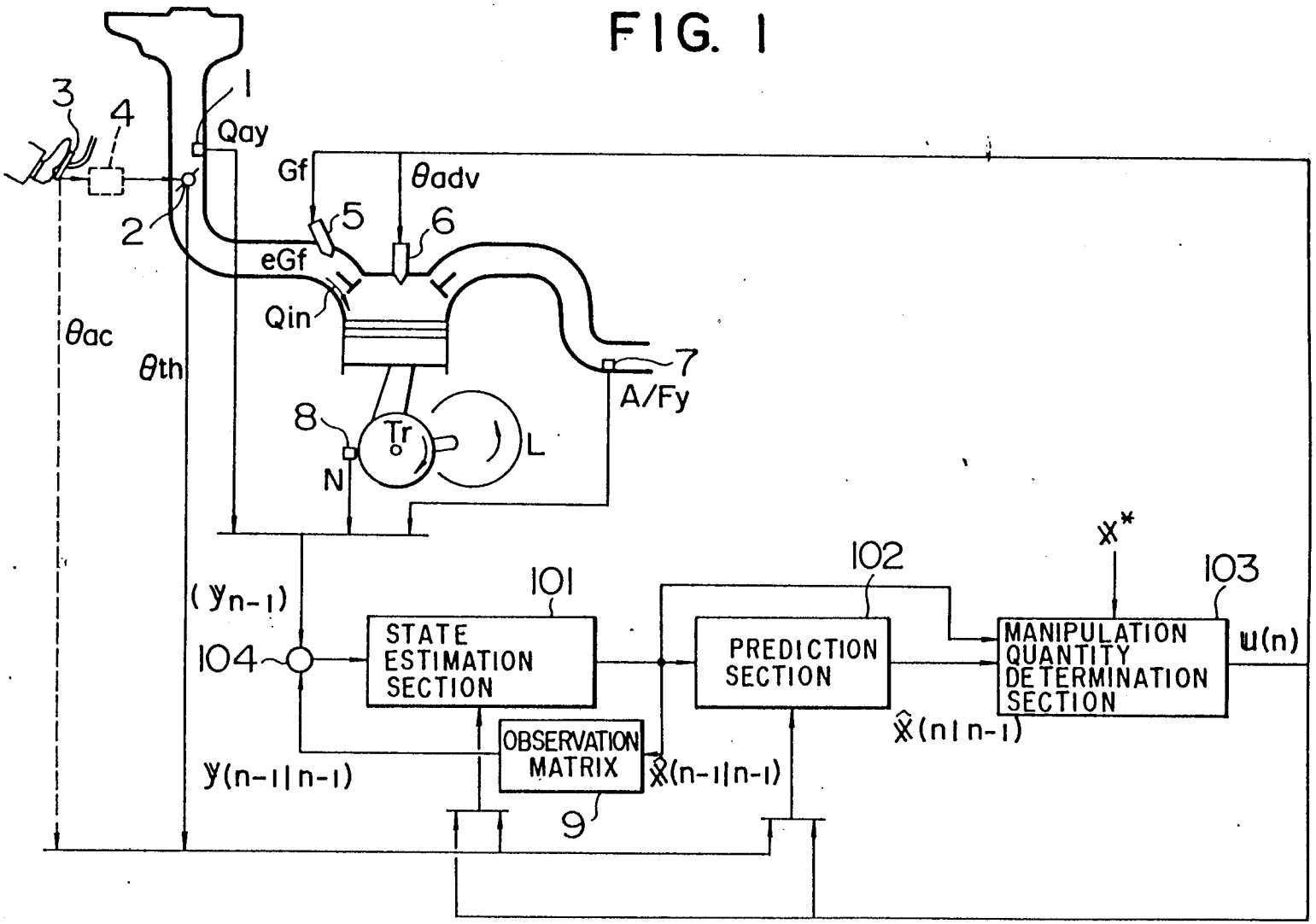
FIG. 1 is a schematic diagram showing a basic arrangement of an embodiment of the present invention.

The embodiments of the present invention will be described with reference to the drawings. As shown in FIG. 1, as a means for measuring a state of an engine, an air flow meter 1 at a manifold inlet, a crank angle meter 8, and an exhaust gas air-fuel ratio meter 7 are provided, and in addition, a throttle angle meter 2 and an accelerator pedal angle meter 3 are provided. The signals from these meters are input to an engine electronic control unit (not shown), and the calculated results are commanded to an injector 5 and an ignition device 6 thereby to perform the control of the engine.

Here, the symbols in the engine system in FIG. 1 are as follows:

$Q_{ay}$: the amount of air flowing into a manifold.
$\theta$th: a throttle angle,
$\theta_{ac}$: an accelerator pedal angle,
$G_f$: a fuel supply command value,
$\theta_{adv}$: an ignition timing,
$eG_f$: a fuel supply executed value,
A/Fy: an air-fuel ratio measured value,
N: an engine speed (rpm)
Tr: a cylinder generated torque, and
L: an engine load.

Figure 2:
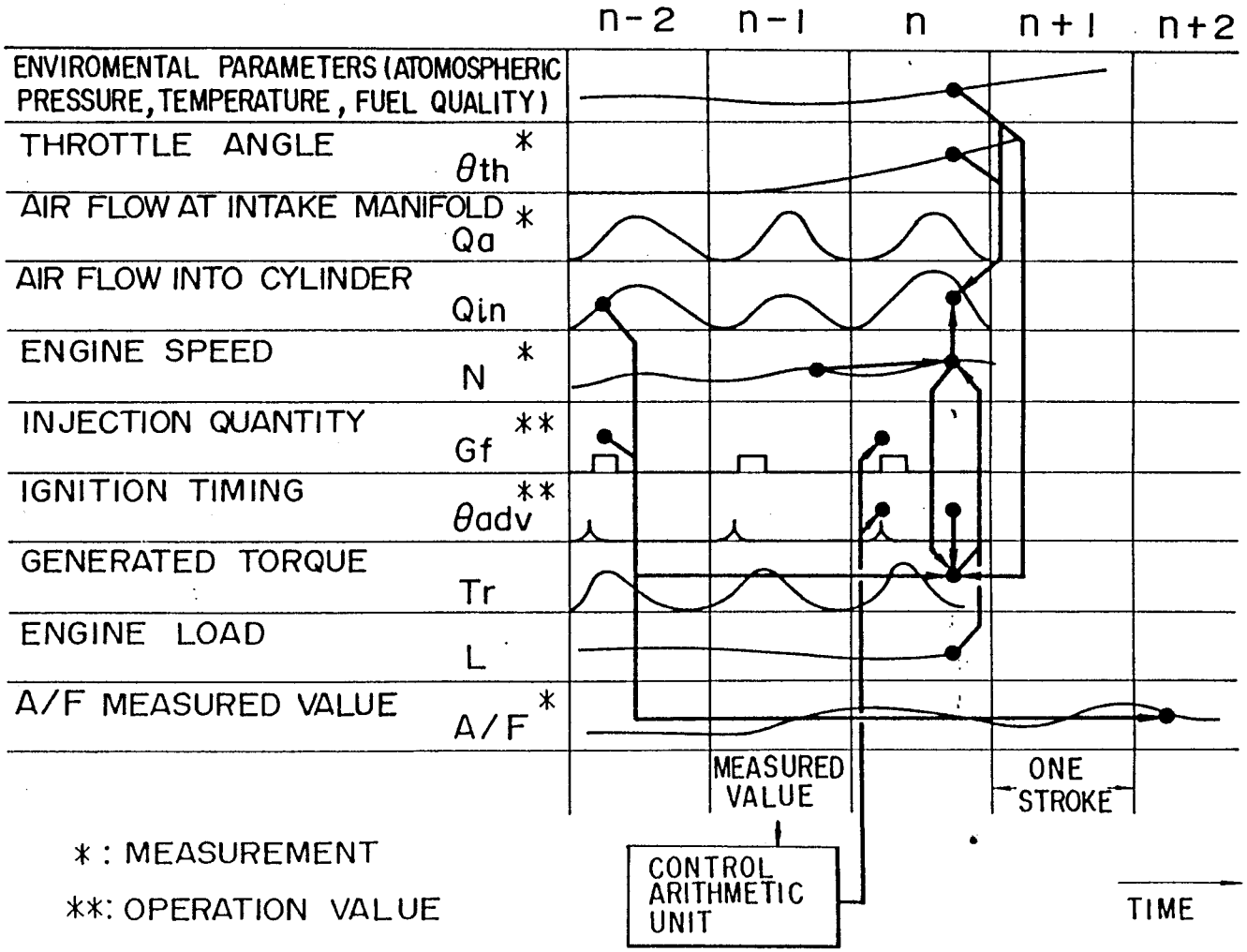
FIG. 2 is a timing chart of measurement and control of physical quantities related to the control of an engine.

These symbols are also used in FIG. 2 to explain the cause and effect relationships of parameters.

FIG. 2 shows the cause and effect relationships of the operation parameters of the engine. Specifically, FIG. 2 shows a change in each operation parameter of the engine which is the object of the control in each stroke. Here, one stroke corresponds to ½ of a revolution in a 4-cycle engine and represents a range of 180° of the crank angle. The left side items represent principal physical quantities, and it is illustrated how each of these quantities changes in each stroke. For example, the amount of air $Q_{in}$ flowing into the cylinder changes in a wave shape in each stroke. This is the result of the ripples of air that are caused due to reciprocating motion of a piston in the cylinder or movement of an intake valve. Environmental parameters are dependent upon atomospheric pressure, atomospheric temperature, quality of fuel, etc., and thus, they change slowly for a period of several strokes shown in FIG. 2, and these parameters may be regarded as approximately constant. The throttle angle $\theta_{th}$ is shown to begin its opening operation in an (n−1)th stroke. Furthermore, it will be seen from a characteristic showing the injection quantity $G_f$ that the fuel is injected intermittently by the injector. In this manner, the changes in the physical quantities representing the dynamic characteristics of the object engine are shown. In FIG. 2, each of thick solid lines has a starting point marked with a black dot • and shows its destination with an arrow →, thereby to indicate the cause and effect relationship for each physical quantity. That is, the black dot • means that this black dot is a factor of a change of the physical quantity which is indicated by the arrow originating from the black dot. For example, it is shown that the engine speed N in the n-th stroke is determined by these factors including an engine speed N(n−1) in the (n−1-)th stroke, an engine load L(n) in the n-th stroke, and a generated torque Tr in the n-th stroke. This cause and effect relationship can be expressed by the relationship formula such as a formula (4) described later. Similarly, it is also shown that the amount of air (air quantity) Q in(n) flowing into the cylinder in the n-th stroke, the generated torque Tr(n) in the n-th stroke, and the air-fuel ratio measured value A/F(n+2) in the (n+2)th stroke respectively indicated by the tips of arrows are changed by parameters corresponding to black dots which are the origins of the arrows. Furthermore, the injection quantity $G_f$ and the ignition time $\theta_{adv}$ are the quantities obtained by the calculation based on the measured values, and they are controlled by the control unit. Accordingly, the starting points of the arrows indicating the $G_f$ and $Q_{adv}$ are in the control arithmetic unit (control unit).

The control system based on the cause and effect relationships shown in FIG. 2 can be represented by a model in the following manner (where, n is a subscript representing a stroke). In this respect, the engine which is to be represented by a model is a 4-cycle, 4-cylinder engine by way of an example.

The amount of air flowing into cylinder:

$$Q_{in}(n)=f(\{\theta_{th}(\tau) \mid \tau\epsilon\theta(n)\}, N(n), N(n-1), \alpha(n)) \quad (3)$$

where, $\theta_{th}(\tau)$: the degree of opening of the throttle valve, $\tau$ is a crank angle in the n-th stroke, and $\theta(n)$ is its a definition range (time width), and $\alpha(n)$: a parameter which changes slowly.

The engine speed:

$$N(n) = \frac{\Delta(n-1)}{I}(Tr(n) - L(n)) + N(n-1) \quad (4)$$

where, $\Delta(n-1)$: required time for the stroke (n−1),
I: turning moment,
Tr(n): generated torque, and
L(n): engine load.

The generated torque:

$$Tr(n) = g(Q_{in}(n-2), e(n-2) \cdot G_f(n-2), N(n), \theta_{adv}(n), \beta(n)) \quad (5)$$

where, $G_f(n-2)$: fuel supply command value in the stroke (n−2), e(n−2): fuel supply effective value in the stroke (n−2),
$\theta_{adv}$ (n): ignition time in the stroke n, and
$\beta$(n) parameter which changes slowly.

The flow meter measured value:

$$Q_{ay}(n-1) = h(Q_{in}(n-1), \{\theta_{th}(\tau)|\tau\epsilon\theta(n-1)\}, N(n-1), N(n-2), \gamma(n-1)) \quad (6)$$

where,
$\gamma$(n−1): parameter which changes slowly.

The air-fuel ratio measured value:

$$A/F_y(n-1)=p(Q_{in}(n-5), e(n-5)G_f(n-5)) \quad (7)$$

The fuel supply command value:

$$G_f(n)=\hat{Q}_{in}(n/n-1)/A/F^*(n) \quad (8)$$

where,
A/F*(n): Air-fuel ratio target value in the stroke in the stroke n, and
$\hat{Q}_{in}$(n/n−1): predicted value of flowing into cylinder in the stroke n which is predicted based on measured information in the strokes up to the stroke (n−1).

The ignition time command value:

$$\theta_{adv}(n) = q(N(n/n^*-1), Q_{in}(n-2), e(n-2)G_f(n-2), Tr^*(n)) \quad (9)$$

N(n/n−1): engine speed predicted value in the stroke n which is predicted based on measured information up to the stroke (n−1), and
Tr*(n) target generated torque.

In the model formulas described above, the engine speed N can be changed even in one stroke, however, a representative value in one stoke is used. There is a possibility of causing a calculation error in the formula (4) including an integration of time synchronization due to the use of the above-mentioned representative value. However, in this case, it is only necessary to narrow an integration width Δ(n−1) sufficiently. (Further, it is also necessary to store in a memory a table of a characteristic pattern of a generated torque vs. ignition time).

The problem of predicting the amount of air flowing into the cylinder is to obtain a prediction value $\hat{Q}_{in}$(n/n−1) of the amount of air flowing into the cylinder in the n-th stroke rationally based on the models of the above formulas (3)–(9), and from the throttle opening degree $\{\theta_{th}(\tau)|\tau\epsilon\theta(i-1)\}$, engine speed N(i−1), required time for stroke Δ(i−1), flow meter measured value $\theta_a$,y(i−1), air-fuel ratio measured value A/-$F_y$(i−1), fuel supply command value $G_f$, and ignition time command value $\theta_{adv}$(i−1) (where, i n) which have been measured up to the (n−1)th stroke.

In the formulas (3)–(9), these parameters $\alpha$, $\beta$, $\gamma$, and $\epsilon$ are included, and it is necessary to estimate these parameters. Further, the engine load L can not be measured actually. However, as compared with a physical quantity which changes for each stroke, the above-mentioned parameters and the engine load L are dependent upon the atmospheric pressure, atmospheric temperature, cylinder wall temperature, dirt at the inlet of the manifold, dirt in the air flow meter, blockage of the fuel supply device (injector), and quality of the fuel. Thus, these parameters change only slowly and may be considered substantially at a constant value. Accordingly, as a variation model changing with time of the above-mentioned parameters may be grasped in the form of the following formula $$X(n)=X(n-1)+\eta_x(n-1) \quad (10)$$

where, $\eta_x$ is a random variable.

When the behavior in the control system is represented by a model in this manner, an estimation theory represented by the Kalman filter can be applied. In order to simplify the expression, such a vector is introduced hereinafter.

The state quantity:

$$DC(n-1) = [Q_{in}(n-1), Q_{in}(n-2), Q_{in}(n-3), Q_{in}(n-4), Q_{in}(n-5), N(n-1), N(n-2), Q_{ay}(n-1), A/F_y(n-1), Tr(n-1), \alpha(n-1), \beta(n-1), \gamma(n-1), e(n-3), e(n-5), L(n-1)]^T$$

The external input:

$$u(n-1) = [\{\theta_{th}(\tau)|\tau\epsilon\theta(n)\},\{\theta_{th}(\tau)|\tau\epsilon\theta(n-1)\} \Delta(n-1), G_f(n-3), \theta_{adv}(n-1)]^T$$

The measured value:
$y(n-1)=[N(n-1), Q_{ay}(n-1), A/F_y(n-1)]^T$

The formulas (3)–(10) can be expressed collectively by using the vectors mentioned above in the following formula $$DC(n)=F(DC(n-1), u(n-1))+v \quad y(n-1)=H\ DC(n-1) \quad (11)$$

where,
V: variable terms $\eta_x$(n−1) for the state quantity and
H: observation matrix.
(Practically, however, since the system is non-linear, the state vectors can not be determined in such a simple manner. Here, with respect to a higher order delay an estimated value which has been obtained heretofore is used as an alternative value.)

The state estimation of the control system shown in FIG. 1 can be achieved by calculating the following formula in accordance with the estimation theory $$\widehat{DC}(n-1|n-1)=\widehat{DC}(n-1|n-2)+K(y(n-1)-HDC(n-1|n-2)) \quad (12)$$
$$\widehat{DC}(n-1|n-2)=F(\widehat{DC}(n-2|n-2), u(n-2))$$

where, K is a gain matrix obtained by the estimation theory. The formula (12) has a recurrent structure with respect $\widehat{DC}$(i|i). Accordingly, only by calculating this item $\widehat{DC}$(i|i) with the progress of the strokes, it is possible to obtain an estimate value which utilizes to the maximum extent the information which has been measured heretofore.

Next, each of the sections shown in FIG. 1 will be described. The state estimation section 101 receives as inputs thereto a measured value (measured vector) y(n−1), an estimate value $\hat{y}$(n−1|n−1) corresponding to a measured vector, and a manipulation vector u(n−2), and calculates in accordance with the formula (12) to obtain the engine state vector estimate value $\widehat{DC}$(n−1|n−1). The observation matrix 9 is an observation matrix H in the second equation in the formula

(11) or in the first equation in the formula (12). The prediction section 102 performs the calculation of the second equation in the formula (12) based on the above-mentioned engine state vector estimation value $\hat{DC}(n-1|n-1)$ and a manipulation vector $U(n-1)$ (here, the index $n-2$becomes $n-1$), and predictes an engine state prediction vector $\hat{DC}(n|n-1)$. In the manipulation quantity determination section 103, a manipulation vector is determined by using the above-mentioned engine state vector estimate value and the engine state prediction vector so as to attain a control target vector DC*.

In order to predict the air amount flowing into the cylinder, the formula (3) which is a part of the formula (11), and the formula (10) (x corresponds to $\alpha$) may be used. However, since the throttle opening degree in the n-th stroke is contained in the formulas and since this is unknown in the $(n-1)$th stroke, either of the following methods is adopted.

(1) Prediction is made from a trend value.

Since the throttle opening degree changes in most cases linearly, the linear prediction is used. In a concrete way, the prediction is attained by the following formula $$\hat{\theta}_{th}(t+\Delta tp|t) = w(\theta_{th}(t), \Delta tp)\cdot\frac{\theta_{th}(t)-\theta_{th}(t-\Delta t)}{\Delta t}+\theta_{th}(t) \quad (13)$$

where, $\theta_{th}(t|t')$: a throttle opeing degree prediction value at a time t which is predicted by using a measured value up to a time t', $w(\theta_{th}(t), \Delta tp)$: a weighting parameter, and $\Delta t$: a measurement sampling period of the throttle opening degree $\Delta tp$.

(When the prediction value exceeds upper and lower limits, upper and lower limit values are used respectively.) This prediction value is a value on the time axis. Hence, this value is converted to a crank angle expression. $\{\hat{\theta}_{th}(\tau)|\tau\epsilon\theta(n)\}$ by the engine speed prediction value $\hat{N}(n|n-1)$ which is determined by the formulas (4) and (5).

(2) Delay element is introduced between the accelerator pedal and the throttle.

The accelerator pedal and the throttle valve are coupled mechanically. If a delay element which is not sensed by a driver is introduced in the coupling, and after detecting a change in the movement of the accelerator pedal, if the throttle angle is predicted based on a coupling transmission characteristic, then a lead time for the prediction will be learned. Thus, as shown by the reference numeral 4 in FIG. 1, a delay element is introduced in a coupling portion between the accelerator pedal 3 and the throttle valve 2. If the delay element 4 is an electrical device, it will become possible to predict a throttle angle from a displacement of the accelerator pedal 3 without fail. When the reliability is considered to be most important, it will be essential to use a mechanical device. In this case, however, it is difficult to realize the complete delay element by using a mechanical device. In order to cope with this difficulty, a delay similar to that caused in the integration is introduced, and the accelerator pedal angle per se may be predicted by a method like the formula (13). Specifically, the accelerator pedal angle is predicted as in the following formula $$\hat{\theta}_{ac}(t+\Delta tp|t) = w'(\theta_{th}(t), \Delta tp)\frac{\theta_{ac}(t)-\theta_{ac}(t-\Delta t)}{\Delta t}+\theta_{ac}(t) \quad (14)$$

$\hat{\theta}_{ac}(t|t')$: an accel pedal angle at a tube t which is pedicted by using a measured value upto a time t', w': a weighting parameter, and $\theta_{ac}$ : an accel pedal angle meter measured value.

By substituting the above result to $\theta_{ac}$ in the following formula, a prediction value of $\theta_{th}$ can be obtained.

$$\theta_{th}=G(s)\theta_{ac} \quad (15)$$

where, G(s) is an accel angle, throttle angle transmission function.

Figure 3:
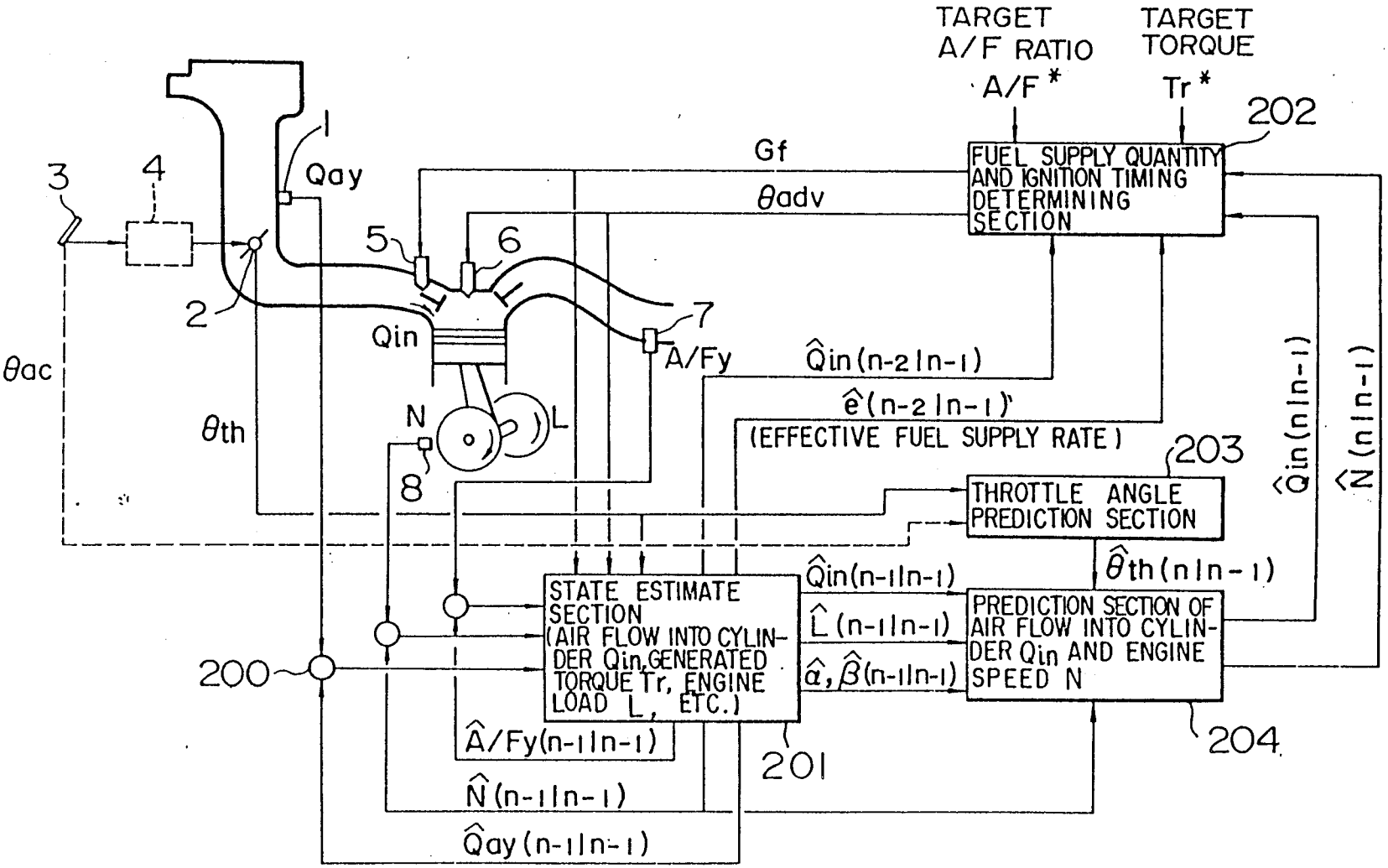
FIG. 3 is a block diagram showing a detailed arrangement of the embodiment.

The overall arrangement of the above embodiment is shown in FIG. 3. In FIG. 3, the engine system which is the object of control is the same as in FIG. 1, and since reference numerals 1–7 designate identical parts, the descriptions thereof are omitted. FIG. 3 shows the overall arrangement of the control system, however, the basic structure is equivalent to that shown in FIG. 1. In FIG. 3, a comparison element 200 is the same as 104 in FIG. 1. A state estimate section 201 in FIG. 3 receives deviations obtained by comparing a measured air-fuel ratio $A/F_y(n-1)$, a measured engine speed $N(n-1)$, and a measured amount of air flowing into the manifold $Q_{ay}(n-1)$, respectively with an estimated air-fuel ratio $\hat{A}/F_y(n-1|n-1)$, an estimated engine speed $N(n-1|n-1)$, and an estimated amount of air flow $Q_{ay}(n-1|n-1)$, and also a fuel supply quantity $G_f$ and an ignition timing $\theta_{adv}$which are the manipulation quantities are inputted. By using these signals, the state estimate section 201 estimates based on the formula (12) the amount of air flow into the cylinder $Q_{in}(n-2|n-1)$, the effective fuel supply rate $e(n-2|n-1)$, the engine load $L(n-1|n-1)$, the parameters which change slowly $\alpha(n-1|n-1)$, $\beta(n-1|n-1)$, the air-fuel ratio $A/F_y$, the engine speed N, and the amount of air flow into the manifold $Q_{av}$.

A throttle angle prediction section 203 performs a prediction based on the prediction method of the formula (13) using the aforementioned trend values for prediction, or based on the formulas (14) and (15) by introducing the delay element between the accelerator pedal and the throttle valve. A prediction section 204 of the amount of air $Q_{in}$ flowing into the cylinder and the engine speed N predicts the amount of air flowing into the cylinder $Q_{in}(n|n-1)$, and the engine speed $N(n|n-1)$ by using the throttle angle prediction value $\theta_{th}(n|n-1)$, the estimate value of the amount of air $\hat{Q}_{ac}(n-1|n-1)$ flowing into the cylinder, the engine load estimate value $L(n-1|n-1)$, the engine speed estimate value $\hat{N}(n-1|n-1)$, and the parameter estimate values $\hat{\alpha}$, $\hat{\beta}$ which have been calculated in the state estimate section 201. A fuel supply quantity and ignition time determining section 202, determines the fuel supply command value $G_f$and the ignition timing $\theta_{adv}$from the above-mentioned calculated information by using the formulas (8) and (9) so that a target air-fuel ratio A/F*, and a target torque Tr* are attained. In the embodiment described above, as will be seen from the formulas defining the control operation, the amount of calculation is relatively large. As a result, it is impossible in some cases to execute the calculations by a small scale arithmetic unit. At the time of high engine speeds, since the inertia of the generated torque is large as compared with a change in the engine load, it is feasible, instead of calculating the fuel supply quantity in each stroke, to calculate the fuel supply quantity by suitably sampling the strokes and to provide as a fuel supply command value by holding the calculated fuel supply quantity. However, at the time of low engine speeds, since the inertia of the torque is small, the influence of a change in the engine load which is an external disturbance factor becomes significant. As a result, it is necessary to accurately calculate the fuel supply quantity for each stroke. A simplified method of the above embodiment for enabling, a small scale arithmetic unit to execute will be described hereinafter.

(1) A simplified prediction method by the engine speed.

This method is based on a point of view that the amount of air $Q_{in}(n)$ flowing into the cylinder is determined basically by a throttle angle $\{\theta_{th}(\tau)|\tau\epsilon\theta(i)\}$ and an engine speed N(i) ($i \leqq n-1$). Specifically, it is intended to predict the $Q_{in}(n)$ by the following functional formula $$Q_{in}(n)=f_{s1}(\{\theta_{th}(\tau)|\tau\epsilon\theta(i)\}, N(i); P_{s1}|i\leqq n-1) \quad (16)$$

where, $P_{s1}$ is a parameter. As a concrete form, there is a formula as shown below $$Q_{in}(n) = \sum_{k-1} P_{S1,N} \cdot N(n-k) + \sum_{k}\sum_{\tau} P_{s1,\theta}\theta_{th}(\tau k) + P_{S1,0} \quad (17)$$

In the formula (16), the parameter $P_{Sl}$ is included. However, this parameter is estimated in the following manner and the result is utilized sequentially.

It is difficult to measure the amount of air flowing into the cylinder by the on-board system. However, the measurement is possible by an experimental device, and by this device, by using the amount of air measured value $Q_{ay}$, throttle opening degree $\theta_{th}$, and engine speed N, a functional formula can be obtained as in the following formula $$\widetilde{Q}_{in}(i)=g_{S1}(Q_{ay}(i), \{\theta_{th}(\tau)|\tau\epsilon\theta(i)\}, N(i)) \quad (18)$$

where, $Q_{in}$ is the amount of air flowing into the cylinder obtained by a model formula.

In this formula, as an explanatory factor, the measured value in the same stroke is used. However, the measured values in the preceding and succeeding strokes may be added.

When the amount of air flowing into the cylinder is calculated posteriorly as in the formula (18), this result is used to obtain the parameter $P_{S1}$ so that the $J(P_{S1})$ in the following formula becomes minimum $$J(P_{S1}) = \sum^{n-1} \rho(j)\,(Q_{in}(j) - f_{S1}(j))^2 \quad (19)$$

where, $\rho(j)$ is a weighting function.

By substituting the parameter $P_{S1}$ obtained here, it is possible to obtain the amount of air flowing into the cylinder in the n-th stroke. In the formula (16), the throttle opening degrees up to the (n−1)th stroke are utilized. However, the throttle opening degrees up to the n-th stroke are included as the explanatory factor, and the prediction value obtained by the throttle opening degree predicting method described in the foregoing may be used. In this respect, since the calculation of the parameter $P_{S1}$ which makes the formula (19) minimum is carried out by a recurrent functional formula, the calculation load does not become large. Furthermore, in the formula (16), the air flow measured value $Q_{ay}$ (i) may be added as the explanatory factor. This is useful to take the inertia effect in the air within the manifold into consideration.

The output value of the exhaust gas air-fuel ratio sensor is used to correct a coefficient multiplied to the fuel supply command value $G_f(n)$. This is based on the view that the reason why the air-fuel ratio is difficult to maintain the target value is due to blockage in the supply device (injector), and the quality of the fuel. The correction coefficient e(n) is estimated as in the following formula $$e(n)=e(n-1)+Ke(A/F^*(n-5)-A/F_y(n-5)) \quad (20)$$

where, Ke is an estimate gain, and the actual fuel supply command is calculated by $$e(n)Q_{in}(n|n-1)/A/F^*(n) \quad (21)$$

(2) A simplified prediction, method by torque estimation.

This method utilizes the fact that the generated torque can be predicted from the estimate value of the amount of air flowing into the cylinder, the fuel injection quantity, and the ignition time in the past. From this result, a change in the engine speed is predicted, and furthermore, it is intended to predict the amount of air flowing into the cylinder by using a throttle opening degree (predicted value). For this purpose, a model relating to each physical quantity is established as follows.

The amount of air flowing into the cylinder:

$$Q_{in}(n)=f_{S2}(\}\theta_{th}(\tau)|\tau\epsilon\theta(n), N(n))\} \quad (22)$$

The engine speed:

$$N(n) = \frac{\Delta(n-1)}{I}(Tr(n) - L(n)) + N(n-1) \quad (23)$$

The generated torque:

$$Tr(n) = g_{S2}(Q_{in}(i-2), e(n-2)G_f(n-2), N(n-1), \theta_{adv}(n)) \quad (24)$$

The air-fuel ratio measured value:

$$A/F_y(n-1)=p(Q_{in}(n-5), e(n-5)G_f(n-5)) \quad (25)$$

The relationship between the amount of air flowing into the cylinder and the air flow measured value:

$$\widetilde{Q}_{in}(n-1) = g_{S1}(Q_{ay}(n-1); \{\theta_{th}(\tau)|\tau\epsilon\theta_f(n-1), N(n-1)) \quad (26)$$

The differences between the method based on the precise model formulas and this simplified method reside in that in the latter, the formula (22) is used only for the prediction of the amount of air flowing into the cylinder and the formula (26) is used to establish the relation with respect to the air flow meter measured value, the equation system is formed in the difference type as far as possible and it makes it unnecessary to solve the simultaneous equation, and the parameters to be estimated are reduced to only the load L and the supply effective value e thereby to reduce the load of calculation for prediction. The estimation and prediction based on these equation systems can be performed in a similar manner as in the method described in the foregoing.

Figure 4:
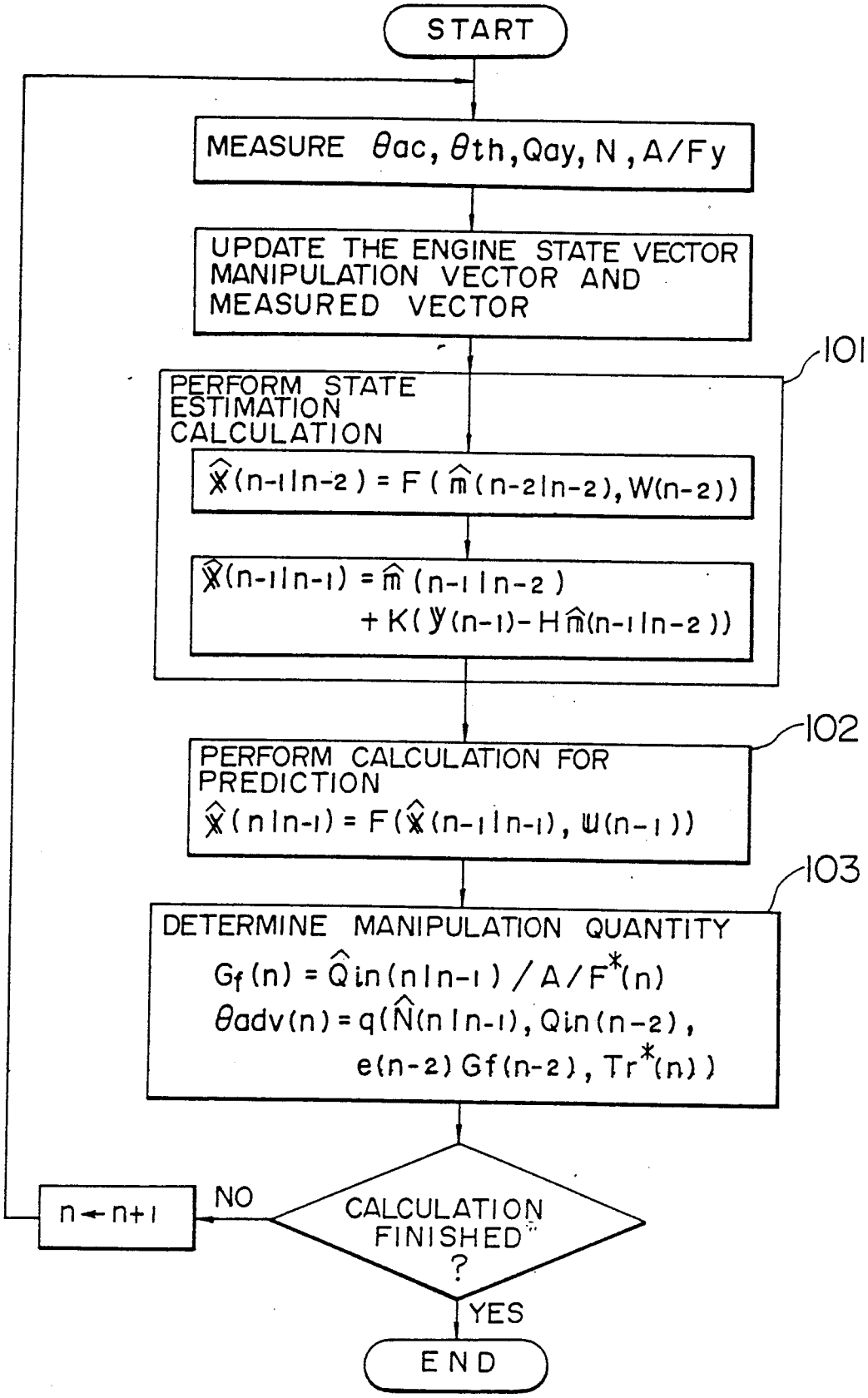
FIG. 4 is a flowchart showing a control procedure when the control shown in FIG. 1 is performed by a microcomputer.

The embodiments are described in the foregoing. In the control system, a cooling water temperature $T_W$ is measured in many cases. Accordingly, it is useful in reducing the load of calculation for prediction to set the parameters included in the model formulas in a functional formula of the cooling water temperature $T_W$ or in a table. In FIG. 4, there is shown a flowchart of a processing procedure when the processing of FIG. 1 is executed by a microprocessor or the like.

In the present invention, the logic is formed based on a dynamic logical formation as compared with the prior art control logic in which the control is directed to the steady state and at the time of a transient state, the correction is made in accordance with the situation.

Therefore in the present invention, the following advantages are provided.

(1) Heretofore, not less than 50% of the period has been spent to develop the correction method during a transient state in the engine operation in order to apply the control logic to engines of various types. In the present invention, since the logical formation is clear, such a period can be reduced to a great extent.

(2) Since the logic itself is formed based on the dynamic phenomenon, the control can be applied to all regions including the steady state and transient state operation of the engine with high controlling performance. Furthermore, the control logic with respect to the transient state can be adapted to the actual apparatus which has been impossible.

We claim:

1. A method for determining control variables of an engine of an automobile on the basis of engine operating parameters and a target air-fuel ratio, said method comprising the steps of:

(a) measuring a plurality of parameters representing engine operating conditions including an intake air flow at the present state of the engine;

(b) estimating a plurality of unmeasured parameters representing engine operating conditions at the present state of the engine on the basis of said measured parameters;

(c) predicting engine operating conditions at a coming state of the engine on the basis of the measured parameters and the estimated parameters;

(d) determining control variables at the coming state of the engine on the basis of the predicted engine operating conditions; and (e) said estimating step including a step for estimating said unmeasured parameters on the basis of difference values between the measured parameters and the corresponding estimated parameters.

2. A method according to claim 1, wherein said estimating step further includes a step for estimating said unmeasured parameters on the basis of said difference values and the determined control variables.

3. A method according to claim 2, wherein said estimating step is expressed by:

$$\hat{DC}(n-1|n-1)=\hat{DC}(n-1|n-2)+K(y(n-1)-H\hat{DC}(n-1|n-2)$$

$$\hat{DC}(n-1|n-2)=F(\hat{DC}(n-2|n-2), u(n-2))$$

where n: at n-th stroke of the engine (n=1, 2, 3, ...)

$\hat{DC}(n-1|n-1)$: estimated state vector of (n−1)th stroke estimated at (n−1)th stroke $\hat{DC}(n-1|n-2)$: predicted state vector of (n−1)th stroke predicted at (n−2)th stroke K: Kalman gain matrix y(n−1): measured vector at (n−1)th stroke H: observation matrix F( 3): prediction matrix u(n−2): control vector at (n−2)th stroke 4. A method according to claim 3, wherein said predicting step includes a step for predicting a throttle angle at a coming state of the engine on the basis of the measured throttle angle at the present state of the engine.

5. A method for determining a fuel flow of an engine of an automobile on the basis of an air flow into a cylinder of the engine and a target air-fuel ratio, comprising the steps of:

(a) measuring a throttle angle and an engine speed at tho present state of the engine;

(b) predicting the air flow to a cylinder at a coming state of the engine on the basis of the measured throttle angle and engine speed wherein said predicting step is expressed by:

$$J(P_{S1}) = \sum^{n-1} \rho(j)\,(Q_{in}(j) - f_{S1}(j))^2$$

where k=1, 2, 3, . . .

$P_{s1}$: characteristic parameter

N(n−k): engine speed at (n−k)th stroke $\theta$: code address of throttle opening degree ($\theta_{th}$)

Tk: sampling time for observing throttle opening degree; and (c) determining the fuel flow at the coming state of the engine on the basis of the predicted air flow into a cylinder and the target air-fuel ratio.

6. A method according to claim 5, wherein said parameter $P_{s1}$ is expressed by:

$$Q_{in}(n) = \sum_{k-1} P_{S1,N} \cdot N(n-k) + \sum_{k}\sum_{\tau} P_{s1,\theta}\theta_{th}(\tau k) + P_{S1,0}$$

where $$Q_{in}(i)=g_{s1}(Q_{ay}(i),$$

$$\{\theta_{th}(\tau)|\tau\epsilon\theta(i)\}, N(i))$$

$\rho(j)$: weighting function $f_{s1}(j)$: measured value of air flow into a cylinder $g_{s1}$: function formula $Q_{ay}(i)$: measured air flow $\{\theta_{th}(\tau)|\tau\epsilon\theta(i)\}$: throttle opening degree at time $\tau$ in i-th stroke N(i): engine speed 7. A method for determining a fuel flow of an engine of an automobile on the basis of an air flow into a cylinder of the engine and a target air-fuel ratio, said method comprising the steps of:

(a) measuring a throttle angle and an engine speed at the present state of the engine;

(b) predicting an output torque of the cylinder at a coming state of the engine on the basis of an air flow into a cylinder, a fuel flow and an ignition timing at a past state of the engine;

(c) predicting an engine speed at a coming state of the engine on the basis of the predicted output torque;

(d) predicting a throttle angle at a coming state of the engine of the basis of the engine speed and the ignition timing at the past state of the engine;

(e) predicting an air flow into a cylinder at the coming state of the engine on the basis of the predicted throttle angle, ignition timing and engine speed; and (f) determining the fuel flow at the coming state of the engine on the basis of the predicted air flow into the engine and the target air-fuel ratio.

8. A system for controlling an engine of an automobile by determining values of fuel flow to the engine and ignition timing of the engine on the basis of engine operating parameters and a target air-fuel ratio, said system comprising:

(a) means for measuring a plurality of parameters representing engine operating conditions including an intake air flow, throttle angle, engine speed and air fuel ratio at the present state of the engine;

(b) means for estimating a plurality of unmeasured parameters representing engine operating conditions including air flow into a cylinder, output torque and engine load at the present state of the engine on the basis of said measured parameters;

(c) means for predicting a throttle angle at a coming state of the engine on the basis of the measured throttle angle at the present state of the engine;

(d) means for predicting air flow into a cylinder and engine speed at a coming state of the engine on the basis of the measured parameters, the estimated parameters and the predicted throttle angle at the coming state of the engine; and (e) means for determining the fuel flow to the engine and the ignition timing at the coming state of the engine on the basis of the predicted engine opening parameters and the target air fuel ratio and a target output torque.

9. A system according to claim 8, wherein said estimating means includes feedback means for determining difference values between the measured parameters and the corresponding estimated parameters, said estimating means estimating the plurality of unmeasured parameters on the basis of said difference values.

* * * * *